US009961461B2

(12) United States Patent
Brown et al.

(10) Patent No.: US 9,961,461 B2
(45) **Date of Patent: *May 1, 2018**

(54) AUDIO PROCESSING SYSTEM

(71) Applicant: Harman International Industries Ltd., Potters Bar Herfordshire (GB)

(72) Inventors: Andy Brown, Middlesex (GB); Philipp Sonnleitner, Gleisdorf (AT); Robert Huber, Schlieren (CH); Björn Sörensen, Zurich (CH); Detlef Meier, Stafa (CH)

(73) Assignee: Harman International Industries Ltd., Potters Bar Hertfordshire (GB)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/078,407

(22) Filed: Mar. 23, 2016

(65) Prior Publication Data

US 2016/0205486 A1 Jul. 14, 2016

Related U.S. Application Data

(63) Continuation of application No. 13/433,905, filed on Mar. 29, 2012, now Pat. No. 9,306,685.

(30) Foreign Application Priority Data

Mar. 30, 2011 (EP) ..... 11160535

(51) Int. Cl.
*H04R 29/00* (2006.01)
*H04H 60/04* (2008.01)

(52) U.S. Cl.
CPC ..... *H04R 29/00* (2013.01); *H04H 60/04* (2013.01)

(58) Field of Classification Search
CPC .. G10H 1/0008; G10H 1/0066; G10H 1/0025; G10H 7/00; G10H 2220/096; H04H 60/04; H04H 1/00; H04S 7/40
(Continued)

(56) References Cited

U.S. PATENT DOCUMENTS 6,985,595 B2 1/2006 Kohyama et al.
7,693,289 B2 4/2010 Stathem et al.
(Continued)

FOREIGN PATENT DOCUMENTS

EP 1580910 A2 9/2005
EP 1841108 A1 10/2007
(Continued)

OTHER PUBLICATIONS

European Search Report for corresponding Application No. 11 160 535.8, dated Sep. 19, 2011, 5 pages.
(Continued)

*Primary Examiner* — Paul S Kim
*Assistant Examiner* — Friedrich W Fahnert
(74) *Attorney, Agent, or Firm* — Brooks Kushman P.C.

(57) ABSTRACT

An audio processing apparatus is configured to process audio signals from a plurality of sources. The audio processing apparatus may include a digital interface to receive status data indicating a status of at least one source, and an optical output device having a plurality of groups of graphics display areas which are respectively assigned to one of a plurality of audio channels of the audio processing apparatus. The audio processing apparatus may also include a control device configured to receive the status data, to determine at least one group of graphics display areas based on the received status data, and to control a graphics display area of the determined at least one group to display graphics generated based on the received status data.

7 Claims, 4 Drawing Sheets

(58) Field of Classification Search
USPC ... 381/56, 58, 102–104, 107, 109, 119, 120; 84/645, 601, 602, 609; 715/716, 727; 345/501; 700/94
See application file for complete search history.

(56) References Cited

U.S. PATENT DOCUMENTS

| | | | | |
|---|---|---|---|---|
| 8,005,243 | B2 | 8/2011 | Terada et al. | |
| 8,189,602 | B2 | 5/2012 | Nakayama et al. | |
| 2003/0063760 | A1 | 4/2003 | Cresci et al. | |
| 2004/0136549 | A1 | 7/2004 | Pennock et al. | |
| 2005/0113021 | A1 | 5/2005 | Gosieski, Jr. et al. | |
| 2005/0226430 | A1* | 10/2005 | Kreifeldt ..... | H04H 60/04 381/58 |
| 2007/0227342 | A1 | 10/2007 | Ide et al. | |
| 2008/0175413 | A1 | 7/2008 | Okabayashi | |
| 2008/0219478 | A1 | 9/2008 | Aoki et al. | |
| 2008/0226086 | A1 | 9/2008 | Kageyama et al. | |
| 2011/0007666 | A1 | 1/2011 | Gurdan et al. | |
| 2012/0027230 | A1 | 2/2012 | Okabayashi | |

FOREIGN PATENT DOCUMENTS

| | | | |
|---|---|---|---|
| EP | 2268057 | A1 | 12/2010 |
| JP | 200847970 | A | 2/2008 |
| JP | 2008252655 | A | 10/2008 |
| JP | 201034983 | A | 2/2010 |

OTHER PUBLICATIONS

Japanese Office Action for corresponding Application No. 2012-071120, dated Dec. 22, 2015, 8 pages.
Canadian Office Action for corresponding Application No. 2,770,693, dated Mar. 10, 2016, 4 pages.

* cited by examiner

AUDIO PROCESSING SYSTEM

PRIORITY CLAIM

This application is a continuation of U.S. application Ser. No. 13/433,905 filed Mar. 29, 2012, which, in turn, claims priority to EP Application No. 11 160 535.8 filed Mar. 30, 2011, the disclosures of which are hereby incorporated in their entirety by reference herein.

TECHNICAL FIELD

The invention relates to an audio processing system/apparatus for processing audio signals from a plurality of sources and a method of outputting status information. Embodiments of the invention relate in particular to such an audio processing system/apparatus which has an optical output device on which graphics can be displayed.

RELATED ART

Audio processing apparatuses are widely used. Examples include an audio mixing console or a combined audio/video processing apparatus. Such an apparatus generally has inputs for receiving audio signals from plural sources. The sources may be microphones. The audio signals may be processed in plural audio channels and may undergo signal mixing. For illustration, processing techniques that may be applied include filtering, amplification, combining or over-blending of plural audio signals, or any combination thereof.

Audio mixing consoles may be complex devices which allow a wide variety of signal operations and parameters for the operations to be set by a user. Adjusting members are provided which allow a user to adjust settings for the signal processing in the various audio channels. An optical output device having one or more graphics displays may be used to provide optical feedback on the audio processing settings selected by an operator.

SUMMARY

An audio processing system allows information on the status of external sources to be output to a user in an intuitive way. The system may also allow information on the status of external sources to be output such that a user can easily combine the status information with information on internal settings of the audio mixing table, thereby enhancing problem solving capabilities.

For various sound sources, such as wireless microphones, information on the status of such devices may be provided from external to the audio processing apparatus. For example, information on the battery status of a radio microphone, information on a radio frequency (RF) signal strength, information on a mute state set on the microphone or information on an audio level at the wireless microphone may be provided by the audio processing system for use by an operator, such as when adjusting settings of the audio processing apparatus or in problem solving.

When such status information of sources is collected by a dedicated external computer and output on a screen of the computer, it may be challenging for the operator to correctly associate data output on the computer with data output via the optical output device of the audio processing apparatus. In some example configurations, the audio processing system may allow a user to assign inputs to one of several audio processing channels. This can make it even more challenging for a user to correctly combine information output by the audio processing system with information shown on a separate computer.

According to an aspect, an audio processing system for processing audio signals from a plurality of sources is provided. The audio processing system may be configured at least in part as an audio processing apparatus to process the audio signals in a plurality of audio channels and may include adjusting members for adjusting settings for the plurality of channels. As used herein, the terms "audio processing system" and "audio processing apparatus" may be used interchangeably to describe all of a part of the system. The audio processing apparatus may include a plurality of inputs to receive the audio signals and a digital interface distinct from the plurality of inputs. The digital interface may be configured to receive status data indicating a status of at least one source. The audio processing apparatus may include an optical output device including a plurality of groups of graphics display areas. Each one of the groups may include plural graphics display areas and may be respectively assigned to one or more of a number of audio channels. A control device may be coupled to the digital interface and to the optical output device. The control device is configured to receive the status data, to determine at least one group of graphics display areas based on the received status data, and to control a graphics display area of the determined at least one group, in order to display graphics generated based on the received status data.

The audio processing system may be configured such that status information related to external sources may be output via the optical output device. The control device may select one group, or several groups, of graphics display areas based on the received status data. The location at which the status information is output on the optical output device may be controlled in dependence on the source to which the status data relates. Displaying the graphics indicating status information of external sources at the audio processing apparatus may aid the operator in problem solving tasks performed on the audio processing apparatus. The control device may control the optical output device such that the graphics generated based on the received status data may be output in one of the groups which are assigned to the various audio channels. The information on the status of the source may thus be displayed substantially simultaneously with and adjacent to other data relating to the same audio channel. This may mitigates the risk of misinterpreting status information.

In one example, the sources may be microphones, such as radio microphones. In other examples, any other audio related device, such as an amplifier, an instrument, a loudspeaker, a light, a wall controller, and/or any other form of system or device related to an audio system may be the sources. The audio processing apparatus may receive the audio signals and the status data from the sources without requiring a wired connection which connects the sources and the audio processing apparatus. The sources may be configured to transmit the audio signals and the status data over a wireless communication interface. The audio processing apparatus may be configured to receive the audio signals and the status data which were transmitted over a wireless communication interface. The audio processing apparatus may have a wired connection to a hub device, which receives the audio signals and the status data over a wireless communication interface.

The digital interface may be a control interface of the audio processing apparatus. The inputs for receiving the audio signals may include, or may be coupled to, transceivers, such as antennas if the sources include wireless microphones.

The control device may be configured to control the optical output device such that graphics which are generated based on the status data may be displayed simultaneously with other graphical information representing processing settings for the audio channel in which an audio signal from the respective sound source is processed. The control device may be configured to control the optical output device such that the graphics generated based on the status data may be displayed in the same group of display areas as the other graphical information representing processing settings for the audio channel.

The control device may be configured to update the graphics generated based on the status data when new status data is received. Thereby, information on the status of the sources may be displayed in real-time.

The audio processing apparatus may be configured to display the graphics generated based on the status data so as to provide information on the status data in real-time, without requiring a wired connection between the audio processing apparatus and the sources. This can allow the status of sources to be displayed on the optical output device of the audio processing apparatus. Examples of source statuses may include information on one or several of a battery level of the source, a radio frequency field strength of the source which varies as the source is displaced relative to a radio frequency receiver installed in a hub device or in the audio processing apparatus, or a source mute status which is set at the source.

The audio processing apparatus may be configured to display the graphics generated based on the status data so as to provide information on the status of the source in normal operation of the audio processing apparatus, where audio processing is performed. The audio processing apparatus may be configured to display the graphics generated based on the status data without requiring a dedicated screen or menu option to be activated.

The digital interface is configured to interface the audio processing apparatus with other devices which are external to the audio processing apparatus. The other devices may include the sources, such as microphones, or a hub device used to transfer data between the sources and the audio processing apparatus.

The control device may be configured to retrieve a source identifier from the received status data. The source identifier may uniquely identify one source among the sources being received by the audio processing system. The control device may be configured to identify, based on the source identifier, an audio channel to which an audio signal from this source is supplied to the audio processing system. The control device may be configured to determine the one or more groups of graphics display areas associated with a respective source based on the identified audio channel. The control device may determine the one or more groups of graphics display areas such that the status information of the source is displayed in a display area of the group associated with the audio channel in which the signals from the respective source are processed by the audio processing system. This allows the status information of the source to be visually output in a way in which a user directly understands to which audio channel the status information relates.

The audio processing apparatus may have a memory storing first mapping data. The first mapping data may define a mapping between source identifiers and respectively one or more of the inputs of the audio processing system. The control device may be configured to identify the audio channel based on the first mapping data. Such first mapping data may be generated based on a user-defined configuration for the audio processing apparatus. Using the first mapping data, the control device may determine to which input of the audio processing system a source having a given source identifier is connected.

The memory may store second mapping data which define a mapping between the plurality of inputs and respectively one of the audio channels. The control device may be configured to identify the audio channel in which an audio signal from a source is processed based on the first mapping data, the second mapping data and the source identifier. Using such second mapping data, a user-defined setting defining in which audio channels the signals received at various inputs are processed may be taken into account when displaying the status information. Using the first mapping data and second mapping data, user-defined adjustments in the mapping between inputs and audio channels during ongoing operation may be performed and taken into account.

The control device may be configured to determine whether the second mapping data is modified and to selectively identify another channel to which the audio signal from the at least one source is provided if the second mapping data is modified. Thereby, the location at which the status information for a given source is displayed may be automatically updated, such as by changing to a different location, when the user modifies the mapping between inputs and audio channels.

The control device may be configured to process the audio signals in the audio channels based on the second mapping data. The control device may serve as a digital sound processor which processes the audio signals in one of the plural audio channels, with the respective audio channel being selected based on the second mapping data.

The control device may be configured to control another graphics display area of the selected at least one group to simultaneously display graphics generated based on the audio processing settings. Thereby, graphics related to audio processing settings for an audio channel and status information for the source which provides the audio signal for the respective audio channel may be displayed substantially simultaneously.

The control device may be configured to store a source status record in the memory. The control device may be configured such that, when new status data are received, the control device retrieves the source identifier and updates a portion of the source status record associated with the respective source identifier. Based on the source status record which is updated when required, graphics relating to the status of the sources may be displayed in real time while requiring status data to be transmitted to the audio processing apparatus only when the status changes.

The optical output device may be configured to sense actuation of graphics display areas and to generate an actuation signal based therefrom. The optical output device may include touch-sensitive sensors. The optical output device may include proximity sensors. The control device may be configured to adjust, based on the actuation signal, a display mode for the graphics generated based on the received status data. The control device may be configured to adjust the display mode for the graphics which represents the status information of an external source when the optical output device senses actuation of the graphics display area in which the status information of the external source is displayed.

The control device may be configured to enlarge an area in which the graphics generated based on the received status data is displayed, when the optical output device senses actuation of the graphics display area in which the status information of the external source is displayed. Thereby, the mode for outputting the status information of the external source may be switched between an overview mode and an enlarged mode which shows more details relating to the status.

In the enlarged mode, the control device may control the optical output device such that numerical parameter values defining the status of the respective source are displayed. The numerical values may be displayed in addition to or instead of other graphical information, such as icons, which are generated based on the status data.

The digital interface may be a network interface, such as an Ethernet interface. This allows the status data to be transmitted in an Ethernet-based protocol. The status data may respectively include a source identifier and parameter values which represent the status of the respective source. The status data may include parameter values such as a battery level, an RF signal strength, an audio level, a radio frequency, a source mute status of the source, or any other parameters related to a particular source.

The audio processing apparatus may be an audio mixing console or a combined audio/video processing apparatus. The audio processing apparatus may be a digital audio mixing console.

In another example, an audio system may include any number of different sources for audio signals and the audio processing apparatus. The sources may be coupled to the inputs of the audio processing apparatus to provide the audio signals thereto. The sources may be coupled to the digital interface to provide the status data thereto. In such an audio system, information on the status of the sources may be output via the optical output device of the audio processing apparatus. The information on the status of a source may respectively be graphically output substantially simultaneously with other information relating to the internal operation of the audio processing apparatus. This allows an operator to capture information on the status of the sources in combination with information on audio processing settings, thereby enhancing problem solving capabilities.

A source may be configured to monitor a pre-determined group of parameter values relating to its status. The pre-determined group may be selected from a group that includes a battery level, an RF signal strength, an audio level, a radio frequency, and a source mute status set on the source, or any other parameters related to sources in the audio system. When the source detects a change in one of the parameter values of the respective source, it may send status data to the audio processing apparatus. By using such a "reporting" data transfer mechanism, the data amounts that need to be transferred to the audio processing apparatus may be kept moderate. The status data at the audio processing apparatus may be updated whenever required, such as resulting from a detected change.

Not all of the sources need to be configured such that they can provide status data. In some examples, there may be some sources which do not provide status data to the audio processing apparatus. The control device of the audio processing apparatus may be configured to automatically detect, based on data received via the digital interface, the sources coupled to the audio processing apparatus which support the outputting of status information.

Some of the sources may be connected indirectly to the audio processing apparatus. The audio system may include a hub device coupled to the plurality of sources and to the audio processing apparatus. Audio signals from the sources may be provided to the inputs of the audio processing apparatus via the hub device. The hub device may perform pre-processing of audio signals. For illustration, the hub device may be responsible for a pre-amplification of the audio signals.

If a hub device is provided, not all sources need to be connected to the hub device. There may be some sources which may be coupled directly to the audio processing apparatus. There may also be several hub devices, with some sources being coupled to the audio processing apparatus via one hub device and other sources being coupled to the audio processing apparatus via another hub device.

The hub device may be configured to monitor a pre-determined group of parameter values for each one of the sources coupled to the hub device and to transmit the source status data when a change in one of the parameter values is detected. The pre-determined group may be selected from a group comprising a battery level, an RF signal strength, an audio level, a radio frequency, and a source mute status set on the source. Thereby, a reporting mechanism is implemented in which source status data at the audio processing apparatus is updated whenever required, as indicated by the detected change. The data amounts that need to be transferred to the audio processing apparatus may be kept moderate.

The plurality of sources may be, or may include, a plurality of microphones. The plurality of sources may be radio microphones. The hub device and the plurality of sources may be configured to wirelessly transmit audio signals and control commands between the hub device and the plurality of sources.

According to another aspect, a method of outputting status information on an optical output device of an audio processing apparatus is provided. The audio processing apparatus processes audio signals in a plurality of audio channels. The audio processing apparatus receives audio signals from a plurality of sources. Status data representing a status of at least one source of the plurality of sources are received via a digital interface of the audio processing apparatus. Based on the received status data, at least one audio channel is determined in which an audio signal from the at least one source is processed. An optical output device of the audio processing apparatus is controlled such that graphics generated based on the received status data and graphics generated based on audio processing settings for the determined at least one audio channel are simultaneously output on a group of graphics display areas which is assigned to the determined at least one audio channel.

Using such a method, information on the status of sources which are provided externally of the audio processing apparatus may be output via the optical output device at the audio processing apparatus. The outputting is implemented in a way which allows the status information to be displayed in the group of graphics display areas which are specifically assigned to the respective channel. Thereby, the risk that the status information may be misunderstood when operating the audio processing apparatus is mitigated.

The method may be performed by the audio mixing system or the audio system. The method may include the system monitoring whether a graphics display area in which status information is displayed is actuated. If actuation is detected, an enlarged view including more detailed information on the status of the source may be output via the optical output device. The received status data may include a source identifier. The method may include the system determining a graphics display area in which the status information is to be output based on the source identifier, based on first mapping data which define a mapping between source identifiers and respectively one of the inputs, and based on second mapping data which define a mapping between the plurality of inputs and respectively one of the audio channels.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
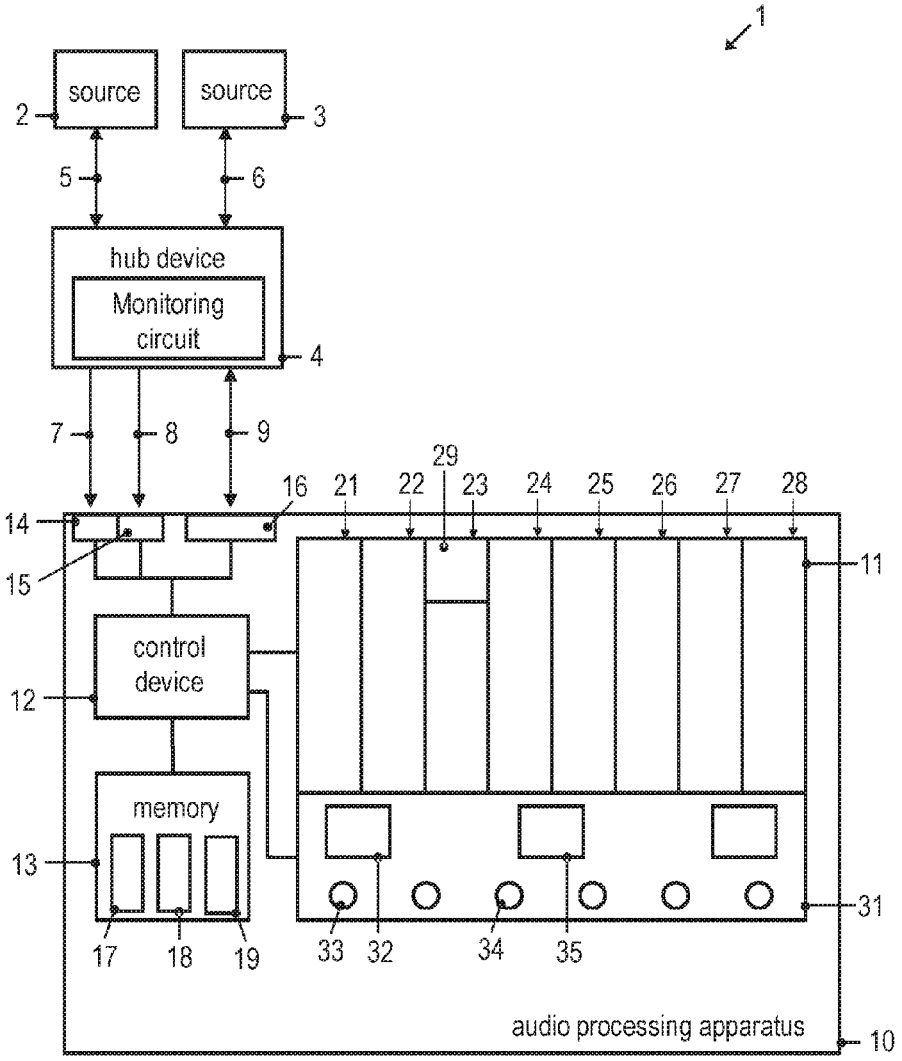
FIG. 1 is a schematic diagram of an example audio system.

FIG. 1 is a schematic diagram of an audio system 1. The audio system 1 includes plural sources 2, 3 and an audio processing apparatus 10. The audio processing apparatus 10 may be an audio mixing console, a combined audio/video processing apparatus, a digital audio mixing console, or a similar apparatus or system. Accordingly, as used herein the term "apparatus" may include a standalone device, or a multi-component distributed system, such as an audio processing system. The audio system 1 may also include a hub device 4. The hub device 4 may be used to couple one or several of the sources 2, 3 to the audio processing apparatus 10.

The audio system 1 may include additional sources (not shown in FIG. 1) which provide audio signals to the audio processing apparatus 10. The additional sources may also be coupled to the audio processing apparatus 10 via the hub device 4. In other implementations, all or some of the sources may be coupled directly to the audio processing apparatus 10.

The sources 2, 3 may be wireless microphones, instruments, amplifiers, or any other audio-related device or system. The sources 2, 3 provide audio signals to the audio processing apparatus 10. The sources 2, 3 may transmit audio signals and status data over a wireless communication interface. Alternatively, one or more of the sources 2, 3 may be coupled by wire to the audio processing apparatus 10. The audio processing apparatus 10 has plural channels in which the audio signals supplied thereto are processed in accordance with audio processing settings. The audio processing settings may be defined by a user, preset and/or dynamically changing based on parameter internal or external to the audio processing apparatus. Examples for processing operations include filtering, amplification, combining, over-blending, and/or any combination of such operations, and/or any other signal processing activity related to the audio signals.

The audio processing apparatus 10 includes an optical output device 11, a control device 12, a memory 13, a plurality of inputs 14, 15 for receiving audio signals and a digital interface 16. The audio processing apparatus 10 may include a second optical output device 31. The second optical output device 31 may be configured as a combined input/output interface having user interface inputs and outputs such as buttons, switches, sliders or rotary dials. To this end, the second optical output device 31 may be provided with adjusting members 33, 34 for adjusting parameter settings of the audio processing apparatus 10. The first optical output device 11 and the second optical output device 31 may include separate user interfaces, such as a display and a series of mechanical controls, respectively. Alternatively or in addition, the first optical output device 11 and the second optical output device 31 may be graphic sections of a single display device or be on different display devices. In other examples, the first optical output device 11 and the second optical output device 31 may include additional display devices, or may include a combination of one or more displays and other user interfaces. In either case, additional mechanical, digital, and/or analog adjusting members (not shown in FIG. 1) may be provided on the interface of the audio processing apparatus 10, for directly adjusting parameters of the audio processing.

The various components of the audio processing apparatus 10 may be combined in a single housing, or may be included in multiple housings. The sources 2, 3 and hub device 4 may be provided externally of the housing. The digital interface 16 is configured to receive data from devices which are provided externally of the housing of the audio processing apparatus 10.

The control device 12 may be a processor or a group of processors. The control device 12 may be configured as, or to include a general processor, a digital signal processor, application specific integrated circuit, field programmable gate array, analog circuit, digital circuit, server processor, combinations thereof, or other now known or later developed processor. The control device 12 may be configured as a single device or combination of devices, such as associated with a network or distributed processing. Any of various processing strategies may be used, such as multi-processing, multi-tasking, parallel processing, remote processing, centralized processing or the like. The control device 12 may be responsive to or operable to execute instructions stored as part of software, hardware, integrated circuits, firmware, micro-code, or the like. The control device 12 is operative to control the outputting of graphics via the optical output device 11 and the further optical output device 31. The control device 12 may further be configured to act as a sound processor which performs processing of audio signals in the plural audio channels. The audio processing may be performed in a user-defined manner. Parameter settings for the audio processing may be input via the input/output interface 31 or via other adjusting members (not shown in FIG. 1).

The optical output device 11 may be a graphics display or may comprise a plurality of smaller graphics displays. The optical output device 11 may be a full graphic display, such as, for example, a liquid-crystal display, a thin-film transistor display, or a cathode-ray tube display. Additionally, or alternatively, the optical output device 11 may be a projection display, such as a head-up display in which optical information may be projected onto a surface. The optical output device 11 may be combined with one or more input devices. For example, the optical output device 11 may be configured as a touchscreen device. In other words, the optical output device 11 may include a touchscreen adapted to display information to a user of the audio system or the audio processing system and adapted to receive inputs from the user touching operating areas displayed on the display. The optical output device 11 may be a dedicated component of the audio processing system or the audio system or may be used together with other audio-related systems, such as, for example, a multi-media system. The optical output device 11 includes graphics display areas which are grouped so as to form a plurality of groups 21-28. Each one of the groups 21-28 is assigned to respectively one of the audio channels. For illustration, group 21 may be assigned to a first audio channel, group 22 may be assigned to a second audio channel etc. The different graphics display areas combined to form a group may include plural physically distinct displays or may be formed by one display.

The control device 12 controls the optical output device 11 such that in a group 21-28 of graphics display areas which is assigned to an active channel to which audio signals are supplied, graphics representing the parameter settings for the respective channel are displayed. Alternatively or additionally, information on possible settings which the user may activate for the respective channel may be output in the respective group. An operator can readily understand to which channel the displayed graphics relate, based on the group 21-28 in which they are shown.

The control device 12 further controls the optical output device 11 such that information on a status of an external source 2, 3 is displayed in one of the groups 21-28. For sources which support displaying of status information at the audio processing apparatus 10, status data is provided to the control device 12 via the digital interface 16. When the control device 12 receives information on a status of an external source 2, 3 as status data, it determines in which one of the audio channels the audio signal from the respective source 2, 3 is processed. The control device 12 controls the optical output device 11 such that graphics which represent the status of the external source are displayed in one of the graphics display areas of the group assigned to the respective audio channel. The graphics representing the status of the external source may be displayed simultaneously with graphics indicating parameter settings for the respective audio channel. The graphics representing the status of the external source may include icons. The icons may represent one, or several, of a battery level, an RF signal strength, an audio level, a radio frequency, and a source mute status of the respective source 2, 3.

For illustration rather than limitation, if external source 2 is a radio microphone which provides audio signals to the input 14, and if audio signals received at input 14 are processed in the third audio channel, the control device 12 determines that the graphics representing the status of the external source are to be displayed in the group 23 which is associated with the third audio channel. The graphics indicating one or several of a battery level, an RF signal strength, an audio level, a radio frequency, and a source mute status of the external source 2 are then displayed in a graphics display area 29 included in group 23. Group 23 is associated with the third audio channel to which the audio signals from the external source 2 are routed.

The status data received at the digital interface 16 may respectively include a unique source identifier identifying one of the sources 2, 3. In addition to the source identifier, the status data include parameter values describing the status of the respective source. The parameter values describing the status may include information on one, or several, of a battery level, an RF signal strength, an audio level, a radio frequency, and a source mute status set at the source. The status data may be data frames or data packets, with separate frames or packets being sent for separate sources. The source identifier may be a device address code, a unique device name or another unique identifier. When status data are received, the control device 12 may retrieve the unique source identifier from the status data and may use the source identifier to determine in which one of the audio channels audio signals from the respective source are processed.

In order to map a source identifier onto an audio channel, various data structures may be stored in memory 13. The memory 13 may include any kind of storage device, such as RAM, ROM, a hard drive, a CD-R/W, a DVD, a flash memory, or any other one or more non-transitory data storage device or system capable of storing data and/or instructions executable by a processor. The memory 13 may store first mapping data 17 which specify, for each one of the sources, at which input 14, 15 audio signals from the respective source are input to the audio processing apparatus 10. This first mapping data 17 may be generated when a user configures the audio processing apparatus 10. To facilitate the configuration process, the control device 12 may automatically detect the sources connected to the audio processing apparatus 10 by communication via the digital interface 16. The names, or other identifying information of the sources may then be output from the sources to the audio processing system, and a user action indicating for each one of the sources the input to which it is connected may be received. The first mapping data 17 may need to be modified only if connections between sources and the audio processing apparatus 10 are altered, such as by adding new sources.

The memory 13 may store second mapping data 18 which specify, for each one of the inputs 14, 15, in which audio channel the audio signals received at the respective input are processed. Assigning inputs to audio channels, also referred to as patching, may again be done in a user-defined manner. For illustration, the user may assign an input to one of the audio channels using adjusting member 33, 34 of the input/output interface 31, or using other adjusting members (not shown), such as a key board, number pad, graphical interface, and/or touch screen of the audio processing apparatus 10.

When status data are received at the digital interface 16 from the sources, the control device 12 may use the unique source identifier included in the status data in combination with the first mapping data and the second mapping data to identify the audio channel in which audio signals from this source are processed. The graphics indicating the status of the source may then be displayed in a graphics display area of the respective group 21-28.

The control device 12 may maintain a source status record 19 in the memory 13. In the source status record 19, parameter values may be recorded for each one of the sources which supports outputting of status information via the audio processing apparatus 10. The parameter values received from the sources may indicate one, or several, of a battery level, an RF signal strength, an audio level, a radio frequency, and a source mute status for the respective source. In other examples, any other form of parameter value related to the sources may be output by the sources as part of the status information. It should be noted that the "source mute status" and "audio level" as used herein relate to status data supplied by the external source, not to an internal parameter of the audio processing apparatus 10. When source data are received, the control device 12 may update the source status record 19. To this end, the control device 12 may retrieve the source identifier from the status data and may determine based on the source identifier which part of the source status record 19 is to be modified. Portions of the source status record 19 which relate to sources other than the one identified by the source identifier included in the status data are not updated. The control device 12 may retrieve information on the status of the respective source from the status data and may overwrite the corresponding information in the source status record 19 with the new information.

In one example operation, the flow of audio signals may be as follows. The sources 2, 3, which may be radio microphones, provide audio signals to the hub device 4. The audio signals may be transmitted wirelessly from the sources 2, 3 to the hub device 4. The hub device 4 may perform pre-processing of the audio signals and may in particular configure signals received from the sources 2, 3 for transmission to the audio processing device 1. For illustration, if the hub device 4 has a wireless digital interface for receiving audio signals and status information from the sources 2, 3, it may convert the status information to the status data and/or may perform a D/A-conversion of the audio signals. If the hub device 4 has an analogue interface to receive audio signals from the sources and the audio processing apparatus 10 has a digital interface for audio signals, the hub device 4 may perform an A/D-conversion of the audio signals. The hub device 4 provides the audio signals 7, 8 to the inputs 14 and 15 of the audio processing apparatus 10. The inputs 14 and 15 may be analogue input lines. There may be point-to-point connections connected to each one of the inputs 14, 15 to provide the audio signals 7, 8 thereto. In another example, the hub device 4 may be coupled to the plurality of inputs of the audio processing apparatus 10 by a bus. In yet another example, the inputs at which the audio signals are received may also be a digital interface.

In operation, control data 5 may be transmitted between the hub device 4 and the source 2 on a first source control data line. The control data transmitted from the source 2 to the hub device 4 includes information on parameter values describing the current status of the source 2. The hub device 4 may query the parameter values from the source 2. Alternatively or in addition, the source 2 may push the parameter values to the hub device 4 based on configurable conditions provided to the source, such as a time delay, a change in a parameter value, or any other condition or event detected by the source. Control data 6 may be transmitted between the hub device 4 and the source 3 on a second source control data line. The source control data 6 transmitted from the source 3 to the hub device 4 may include information on parameter values describing the current status of the source 3. Alternatively, or in addition, the hub device 4 may query the parameter values from the source 3.

Control data 9 are transmitted on a hub device control data line between the hub device 4 and the digital interface 16. i.e., the digital interface 16 may be a control interface of the audio processing apparatus 10. The control data 9 may be transmitted via a wired connection. In other implementations, the digital interface 16 may be a wireless control interface. The hub device 4 may transmit status data to the digital interface 16 based on predetermined conditions, such as when a parameter value received by the hub device 4 from one of the sources 2 or 3 changes, after a predetermined time period, in response to an external signal parameter, or any other condition. The hub device 4 may communicate with the audio processing apparatus 10 over a network, such as an Ethernet network. Alternatively, or in addition, any other network protocol, such as TCP/IP may be used. The network may be a wide area network (WAN), a local area network (LAN) or any other network configuration. In still other examples, the hub device 4 may communicate with the audio processing apparatus over a data highway, dedicated communication lines, shared communication lines, or any other communication pathway. The hub device 4 may generate a data entity, e.g. an Ethernet frame or another type of data packet, such as a TCP/IP packet, which includes a source identifier for the source and the data indicative of the change, such as a new parameter value. For example, if the battery level of source 2 changes, and indication of the change is provided to the hub device 4 over the data control line 5, the hub device 4 may send status data which includes the source identifier for source 2 and at least the new value for the battery level to the audio processing apparatus. Similarly, data packets may be generated when an RF signal strength or audio level at the source 2 changes. The hub device 4, or the respective source itself, may perform a threshold comparison. The status data may be generated and transmitted to the audio processing apparatus 10 if the change in a parameter value exceeds a threshold. When the control device 12 receives the status data, it may update the source status record 19 accordingly. The control device 12 may then control the output device such that graphics corresponding to the new status of the respective source are displayed. For example, when a change in a battery status, RF signal strength or audio level of a source is indicated to the control device 12 by a parameter value included in the status data, an icon indicating the battery status, RF signal strength or audio level may be modified to reflect the new parameter value.

The audio processing apparatus 10 may send control commands via the digital interface 16 to the hub device 4. The control commands may include query commands used to detect sources, or query commands used in a keep alive mechanism to confirm a source is still operation in the audio system. Data transmission between the hub device 4 and the digital interface 16 may be implemented using Ethernet commands or another suitable protocol. Accordingly, the digital interface may include a compatible interface, such as an Ethernet or TCP/IP interface. For example, the digital interface 16 may have an Ethernet interface, and the hub device 4 may also have an Ethernet interface connected to the digital interface 16. If, for example, some source devices which support communication of status data and the displaying of status information at the audio processing apparatus 10 are directly connected to the audio processing apparatus 10, they may also have an interface, such as an Ethernet or TCP/IP interface.

The control device 12 may be configured to modify the displayed status information not only when the status changes, but also based on other events. For example, the graphics representing the status information may be displayed in another one of the groups 21-28 when the operator modifies the mapping between inputs 14, 15 and audio channels. I.e., when an operator selects another audio channel to which a given input is patched, the second mapping data 18 are modified accordingly. The group 21-28 in which the status information for a given source are output may thus be altered to reflect that the audio signal from that source is now processed in another channel.

Alternatively or additionally, the control device 12 may be configured to adjust the area in which the status information is output based on a user action. For example, the outputting of status information may be changed between an overview mode and an enlarged mode. In the overview mode, the control device 12 may control the optical output device 11 such that the status information for a given source is displayed only in one of the graphics display areas, such as area 29, of the associated group 23. In the enlarged mode, the status information may be shown on additional graphics display areas of the optical output device 11, or on display areas of the input/output interface 31. Accordingly, in the enlarged mode additional details on the status information to be output may be included. For example, numerical values and/or enlarged graphics indicating the RF signal strength, audio level, battery level or radio frequency as provided by a source may be displayed in graphics display areas 32, 35 of the input/output interface 31.

The enlarged mode may be activated in various ways. The optical output device 11 may be configured to sense actuation of the various graphics display areas. The optical output device 11 may be a touch-sensitive or proximity-sensing device. When a user actuates the graphics display area 29 in which the status information is displayed in the overview mode, the control device 12 may activate the enlarged mode.

Figure 2:
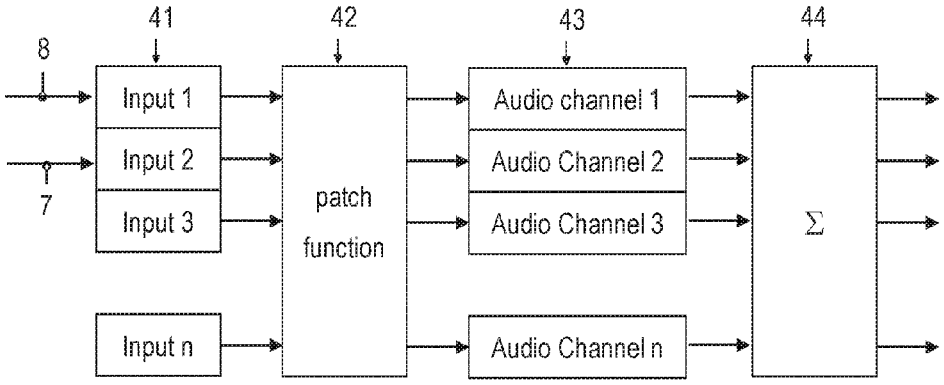
FIG. 2 is a schematic representation for illustrating an example of audio processing in an example audio processing system and the audio system.

FIG. 2 schematically illustrates an example part of the audio processing performed by the audio processing apparatus 10. The control device 12 may be configured to also act as a sound processor. Audio signals are input to the audio processing apparatus at a plurality of inputs 41, or input channels. A patch function 42 serves as a cross-bar which supplies an audio signal received at an input "i" to an audio channel "j". The patch function may be fully configurable such that any one or more of the inputs 41 may be mapped, or routed, to any one or more of the audio channels. Audio processing functions such as filtering, amplification, equalization, delay, or any other audio based processing techniques or functions may be performed in the audio channels 43. Signals from the various audio channels 43 may be combined at 44.

The patch function 42 used in audio processing is based on the second mapping data 17 which are also used by the control device 12 to determine in which one of the groups 21-28 graphics representing status information for a given source is to be displayed. For illustration, a user may select that an audio signal 8 received at "Input 1" is to be processed in "Audio channel 5" and that an audio signal 7 received at "Input 2" is to be processed in "Audio channel 3". The status data for the respective source are then displayed in the corresponding group of graphics display areas.

Figure 3:
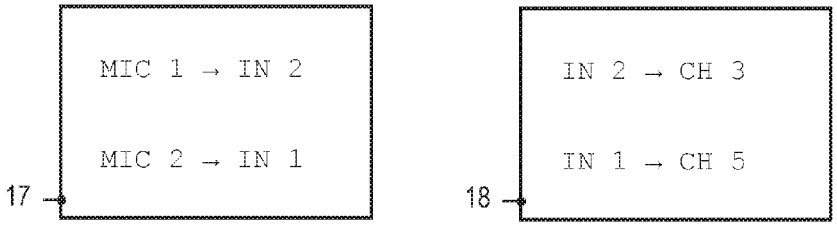
FIG. 3 is a schematic representation of an example of first and second mapping data.

FIG. 3 schematically illustrates an example of first mapping data 17 and second mapping data 18. The first mapping data 17 define the mapping between external sources and inputs of the audio processing apparatus. The second mapping data 18 define the mapping between inputs and audio channels. In the illustrated exemplary first mapping data 17, a source labeled "MIC 1" is connected to "Input 2". A source labeled "MIC 2" is connected to "Input 1". The first mapping data 17 may be generated when the audio processing apparatus is configured by a user. In the illustrated exemplary second mapping data 18, audio signals received at "Input 2" are processed in "Audio channel 3" and audio signals received at "Input 1" are processed in "Audio channel 5".

When the source "MIC 1" supports the outputting of status information via the audio processing apparatus 10, the control device 12 determines that the status information for the source "MIC 1" is to be displayed on a graphics display area in the group associated with "Audio channel 3" based on the source identifier, in this example "MIC 1," included in the source data. When the source "MIC 2" supports the outputting of status information via the audio processing apparatus 10, the control device 12 determines that the status information for the source "MIC 2" is to be displayed on a graphics display area in the group associated with "Audio channel 5" based on the source identifier, in this example "MIC 2,".

Figure 4:
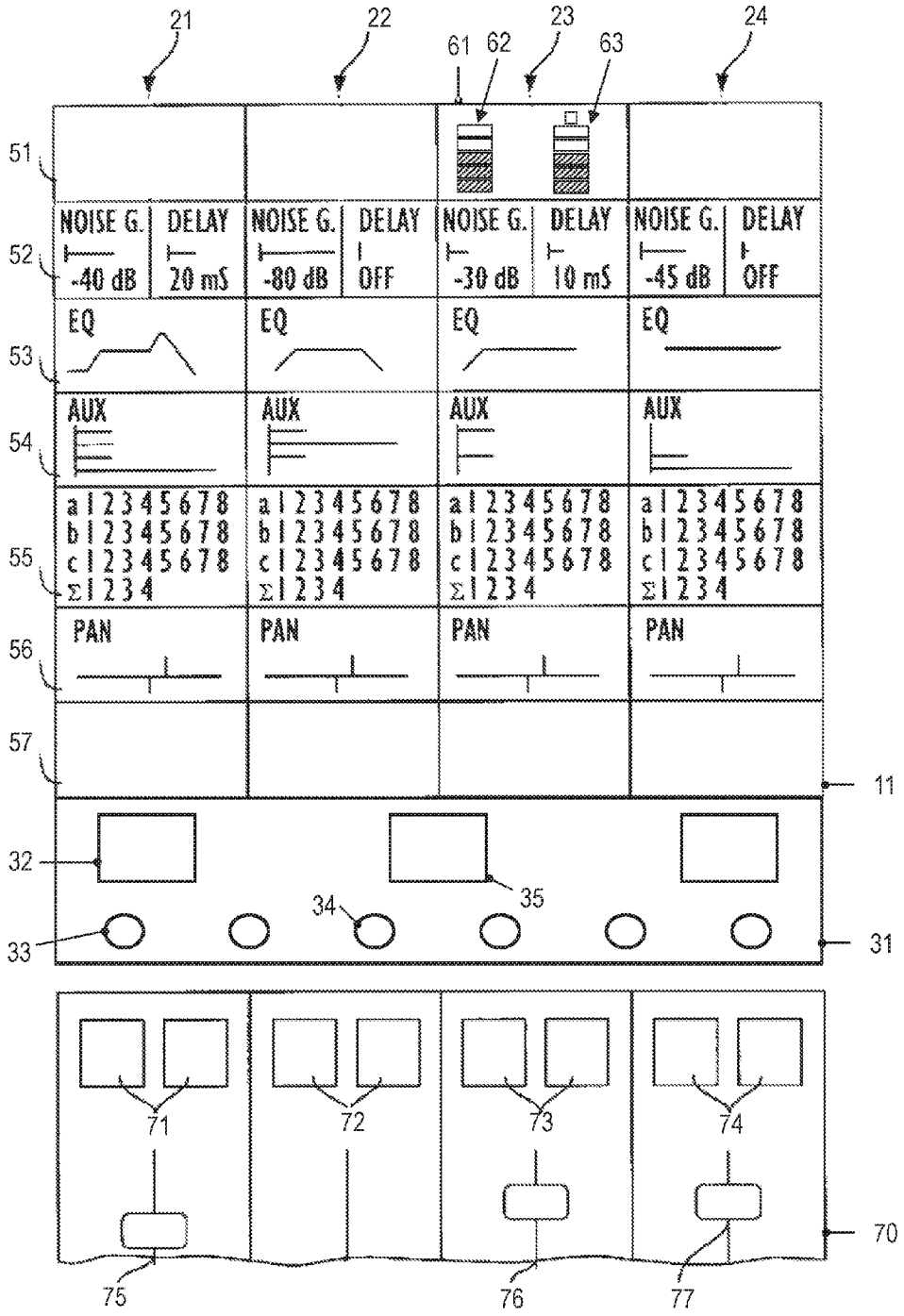
FIG. 4 is a representation of an example graphics output via an optical output device.

FIG. 4 illustrates an example user interface of an audio processing apparatus. The user interface includes the optical output device 11 having groups 21-24 of graphics display areas, the input/output interface 31 and a control portion 70 (not shown in FIG. 1) which has additional mechanical adjusting members. Only four groups 21-24 of graphics display areas are shown for the optical output device 11, it being understood that another number of audio channels and corresponding groups may be used. In addition, the visual layout and configuration of the groups may be different in other examples.

In the optical output device 11, each one of the groups 21-24 includes plural graphics display areas that may be same or different among different groups. The group 21 includes graphics display areas 51-57 that may be substantially simultaneously displayed and updated at substantially the same time. Corresponding graphics display areas may be provided in each other group. Graphics display area 51 may for example be reserved for displaying status information provided as status data from the external source. If the external source does not support this function, an internal setting or name used for the respective source may be displayed in display area 51. Group 23 is associated with an audio channel in which status data signals from a source are processed, which supports the displaying of status information. In the graphics display area 61, several icons 62, 63 are displayed which are generated based on status data. Other status information may be included. For example, an icon 62 representing an RF signal strength or audio level provided by the source may be processed and shown as a bar diagram. Another icon 63, such as representing a battery level received as status data from a source may be shown as a bar diagram.

In the audio processing apparatus 1, information on the status of the external source which is independent of settings and parameters set at the audio processing apparatus 1, may be received and displayed directly on the optical output device 11. It is not required that a dedicated menu or user screen be activated in order for the user to obtain information on the status of the sources. The source data may include a data identifier of different pieces of source data. The data identifiers may be universal identifiers known to both the sources and the audio processing apparatus. Thus, when the audio processing apparatus 10 receives source data and a corresponding data identifier of the source data, the audio processing device is able to display the received source data in the locations in the graphic provided by the optical output device 11 that are identified with a data identifier corresponding with the data identifier associated with the received source data. Non limiting examples of data identifiers may include "RF" for RF field strength, "BATT" for battery level, "MUTE" for a source mute status. The units of the source data may be known based on the corresponding data identifiers. Alternatively or in addition, source data may be provided in percent for analog values and one or more "1" and "0" for digital. Thus, indication of whether the source data is a digital or analog may also be known or included with the source data.

The information on the external source which is displayed on the optical output device 11 may include received information on an RF field strength, indicating the field strength of a radio field generated by the respective source to transmit audio signals and status data, the field strength representing a field strength received at the hub device 4 or at the audio processing apparatus 10, for example. This allows countermeasures to be taken as the source moves away from the hub device 4 and/or the audio processing apparatus 10.

The information on the external source which is displayed on the optical output device 11 may include information on battery level of the source, indicating the battery level of a battery installed in the source. This allows countermeasures to be taken as the battery installed in the source runs out of power.

The information on the external source which is displayed on the optical output device 11 may include information on a source mute status set at the source. This source mute status is set directly at the source and is independent of a mute status set at the audio processing apparatus. This allows a verification to be performed, at the audio processing apparatus 10, whether a source mute status has been activated remotely at the source.

Exemplary graphic display areas are shown in FIG. 4 for other aspects displayed by the optical output device 11. In an overview mode, these other graphics display areas may be used to display data, such as data related to the internal operation of the audio processing apparatus 10. Graphics display area 52, for example, shows the setting of a "Noise Gate", i.e. the setting of a damping element. Graphics display area 52 may include, for each channel a numerical and/or graphic symbol quantifying damping. Graphics display area 53 shows the set frequency characteristic of an equalizer. Graphics display area 54 graphically shows additional functions. Graphics display area 55 shows busses to which the audio output of an input channel can be assigned. For illustration, according to graphics display area 55, signals in a channel labeled "a" may be assigned to one of the busses indicated by symbols "1", . . . , "8". Graphics display area 56, for example, shows the balance of a stereo channel, that is the relative loudness level of the left channel relative to the right channel. Additional graphics display areas 57 may be provided to output additional information on internal settings of the audio processing apparatus 10, or additional status data indicative of an operational status of at least one source from among the sources.

The input/output interface 31 may also be subdivided into groups. The input/output interface 31 may include a display with display areas 32, 35. The display areas of the input/output interface 31 may be integrally formed with the optical output device 11. I.e., the optical output device 11 and the display used in the input/output interface 31 may be different sections of one display screen. Alternatively, different display screens shown substantially simultaneously, or on different display screens may be used.

Adjusting members, such as rotary knobs 33, 34 may be used to set parameters for audio processing in the audio channels. The control device 12 may receive signals from the actuation members 33, 34 and may process the signals based on which of the graphics display areas of the optical output device 11 has previously been activated to trigger a setting operation. I.e., by actuation of one of the graphics display areas 52-57, the user may select a function group for which parameters may then be input using the actuation members 33, 34. The processing in the respective audio channel can be performed in accordance with these audio processing signals. The actuation members 33, 34 may be supported on a transparent carrier which is located in between the actuation members 33, 34 and the display screen which forms the graphics display areas of the input/output interface 31.

When actuation of the graphics display area 61 is sensed, status information relating to the source which supplies signals to the audio channel may be displayed in additional graphics display areas. For illustration, some of graphics display areas 32, 35 of the input/output interface 31 may be used to display numerical values or enlarged graphics representing the status of the respective source at substantially the same time.

The audio processing apparatus may also include another input interface 70 which may include mechanical buttons, faders, knobs or other mechanical members implemented in hardware. For illustration, the input interface 70 may include faders with levers 75-77 and actuation buttons 71-74. The adjusting members of the interface 70 may be used to directly influence or set parameters for audio processing in the various audio channels, without requiring a prior selection of one of different functions using the touch-sensitive display 11. For illustration, some of the buttons may be used to set an internal MUTE state for an audio channel, which is different from the Mute state set on the external source, and the sliders may be used to adjust an output gain of an audio channel output.

Figure 5:
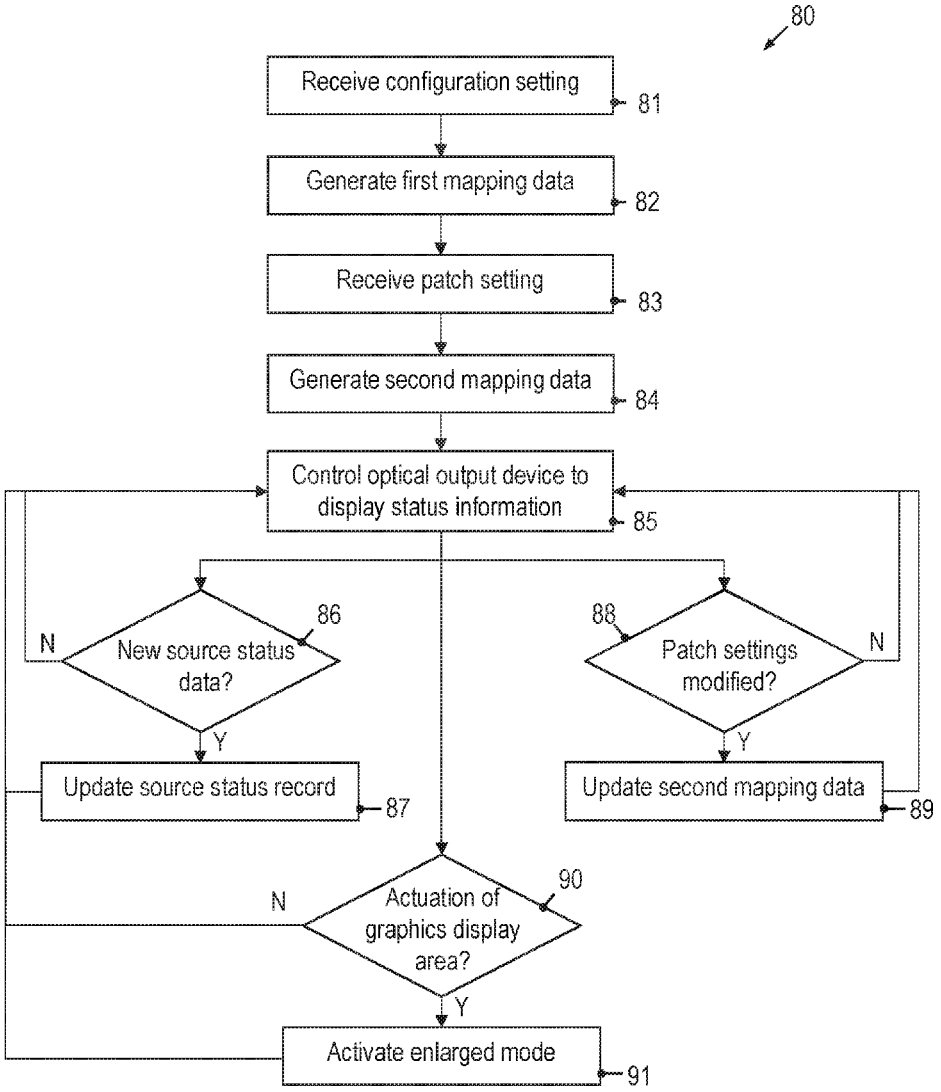
FIG. 5 is a flow chart of an example method of outputting status information.

FIG. 5 is a flow chart of an example method 80 of outputting status information on an optical output device of an audio processing apparatus. The method may be performed by the control device 12 of the audio processing apparatus 10.

At block 81, a configuration setting may be received. The configuration setting may be a user-defined setting defining to which one of the inputs of the audio processing apparatus audio signals from a given source are provided. Sources which also provide status data in the form of control data to the digital interface of the audio processing apparatus may be automatically detected. Source identifiers or names of such sources received in the status data may be output to allow the user to configure the audio processing apparatus more easily.

At block 82, first mapping data may be generated. The first mapping data define a mapping between source identifiers and inputs of the audio processing apparatus. The first mapping data do not need to be determined again, unless connections between sources and inputs of the audio processing apparatus are altered. The first mapping data may be stored in a memory of the audio processing apparatus.

At block 83, a patch setting may be received. The patch setting may be a user-defined setting defining in which audio channels the audio signals received at the various inputs are respectively processed.

At block 84, second mapping data may be generated. The second mapping data may define a mapping between inputs of the audio processing apparatus and audio channels. The second mapping data may need to be updated when a user alters the mapping, or patching, of inputs and audio channels. The second mapping data may be stored in the memory of the audio processing apparatus together with or separate from the first mapping data.

At block 85, the optical output device is controlled such that status information for one external source, or plural external sources, is displayed. The outputting of status information may include receiving status information data which include a unique source identifier and parameter values representing the status of the source. The parameter values may be one or more of a battery level, an RF signal strength, an audio level, a radio frequency, or a source mute status, for example.

A graphics display area is determined at block 90 in which the status information is to be output. In order to determine the graphics display area, the audio channel is determined in which signals coming from a given source are processed. The audio channel may be determined using the source identifier, the first mapping data and the second mapping data. The status information may then be output in a graphics display area of the group of graphics display areas which is associated with the audio channel. In other graphics display areas of this group, information on the signal processing may be shown.

The graphics output in the determined graphics display area is generated based on the parameter values which indicate the status of the source. The graphics may include one or plural icons, such as bar diagrams. If status data is available for more than one source, the outputting of status information is performed for each one of these sources substantially at the same time depending on the graphic configuration of the group of graphic display areas.

While the status information is output, the control device of the audio processing apparatus may monitor several different events and adjusts the output graphics based thereon at substantially the same time.

At block 86, it is determined whether new source data is received. If no new source data is received, outputting of the old status information may be continued at block 85. If new source data is received, at block 87 a source status record stored in the audio processing apparatus may be updated. The new parameter values received for a source may be stored in the respective data fields of the source status record. The outputting of status information is then continued based on the updated source status record.

At block 88, it is determined whether the patch setting is modified. This may happen if, for example, a user re-assigns an input to another audio channel. If the patch settings are not modified, outputting of the old status information may be continued at block 85. If the patch settings are modified, at block 89 the second mapping data is updated. The second mapping data is updated so as to take into account the new assignment of inputs to audio channels. The outputting of status information is then continued based on the updated second mapping data. Thereby, the location at which the status information is displayed is made to relocate in accordance with the new patching.

At block 90, it is determined whether the graphics display area in which the status information is output is actuated. If the area is not actuated, outputting of the old status information may be continued at block 85. If the area is actuated, at block 91 an enlarged mode is activated. In the enlarged mode, additional graphics display areas may be controlled to output status information.

While embodiments have been described with reference to the drawings, various modifications may be implemented in other embodiments. For example, while the sources for which status information may be displayed may be radio microphones, status information may also be output for other types of sources which are provided externally of the audio processing apparatus. In addition to displaying status information for one or more external sources, the status of internal sources of audio signals may also be displayed.

While embodiments of the invention are described herein, the invention is not limited thereto. Embodiments of the invention may be used in various types of audio processing apparatuses which have an optical output device. In addition, it will be apparent to those of ordinary skill in the art that many more examples and implementations are possible within the scope of this invention. Accordingly, the invention is not to be restricted except in light of the attached claims and their equivalents.

What is claimed is:

1. An audio system, comprising:

an audio processing apparatus to receive at least one operational parameter of a source of an audio signal from a hub device, the at least one operational parameter including at least one of a battery level of the source, a radio frequency (RF) signal strength of the source, an audio level supplied by the source, an RF of the source, and a source mute status indicative of the source being in a mute condition, the audio processing apparatus comprising:

an optical output device to display a plurality of groups of graphics display areas, where the audio processing apparatus provides first graphics indicating the at least one operational parameter of the source being displayed in one of the groups of graphics display areas;

a memory device; and a control device coupled to the optical output device and to the memory device, the control device being operative to:

receive a first patch setting corresponding to a first user-defined setting that assigns inputs of the audio processing apparatus to audio channels of the audio processing apparatus;

generate mapping data that defines a mapping of the inputs of the audio processing apparatus to the audio channels of the audio processing apparatus for storage on the memory device after receiving the first patch setting;

receive a second patch setting corresponding to a second user-defined setting that changes an assignment of at least one input of the audio processing apparatus with respect to at least one channel of the audio processing apparatus;

modify the mapping data based on the second patch setting; and shift the first graphics on the optical output device indicating the at least one operational parameter of the source from a display area in one group of the plurality of groups of graphics display areas to a display area in another group of the plurality of groups of graphics display areas after modifying the mapping data.

2. The audio system of claim 1, wherein the control device is further configured to determine second graphics corresponding to a changed at least one operational parameter in response to a detection of a change to the at least one of the battery level of the source, the RF signal strength of the source, the audio level supplied by the source, the RF of the source, and the source mute status.

3. The audio system of claim 2, wherein the control device is further configured to provide the second graphics to the optical output device to display the second graphics corresponding to the changed at least one operational parameter thereon.

4. The audio system of claim 1, further comprising:

a plurality of sources, wherein each source is configured to provide the audio signal.

5. The audio system of claim 4, further comprising:

a hub device for coupling to a corresponding source of the plurality of sources.

6. An audio system comprising:

an audio processing apparatus including:

at least one input to receive at least one operational parameter of a source of an audio signal, the at least one operational parameter including at least one of a battery level of the source, a radio frequency (RF) signal strength of the source, an audio level supplied by the source, an RF of the source, and a source mute status indicative of the source being in a mute condition; and a control device including at least one processor configured to:

receive a first patch setting corresponding to a first user-defined setting that assigns inputs of the audio processing apparatus to audio channels of the audio processing apparatus;

generate mapping data that defines a mapping of the inputs of the audio processing apparatus to the audio channels of the audio processing apparatus for storage on a memory device after receiving the first patch setting;

receive a second patch setting corresponding to a second user-defined setting that changes an assignment of at least one input of the audio processing apparatus with respect to at least one channel of the audio processing apparatus;

modify the mapping data based on the second patch setting; and shift first graphics on the audio processing apparatus indicating the at least one operational parameter of the source from a display area in one group of a plurality of groups of graphics display areas to a display area in another group of the plurality of groups of graphics display areas after modifying the mapping data.

7. The audio system of claim 6 wherein the audio processing apparatus is configured to receive the at least one operational parameter of the source of the audio signal from a hub device.

* * * * *